United States Patent [19]

Itoh

[11] 4,385,826

[45] May 31, 1983

[54] TONER IMAGE FIXING DEVICE

[75] Inventor: Masayuki Itoh, Yokohama, Japan

[73] Assignee: Canon Kabushiki Kaisha, Tokyo, Japan

[21] Appl. No.: 247,756

[22] Filed: Mar. 26, 1981

[30] Foreign Application Priority Data

Apr. 7, 1980 [JP] Japan ..... 55-45330

[51] Int. Cl.[3] ..... G03G 15/20

[52] U.S. Cl. ..... 355/14 FU; 219/216; 355/3 FU; 432/60

[58] Field of Search ..... 355/14 FU, 3 FU; 219/216, 388; 432/60

[56] References Cited

U.S. PATENT DOCUMENTS 4,081,213 3/1978 Bar-On et al. ..... 355/3 FU
4,162,847 7/1979 Brandon ..... 219/216 X
4,163,893 8/1979 Turini ..... 219/216
4,212,631 7/1980 Franke et al. ..... 355/3 FU
4,232,959 11/1980 Ateya et al. ..... 355/3 FU

*Primary Examiner*—R. L. Moses
*Attorney, Agent, or Firm*—Fitzpatrick, Cella, Harper & Scinto

[57] ABSTRACT

A fixing device provided with a heating roller having heating means, a pressure roller for fixing a toner image by transporting a toner image bearing member in cooperation with the heating roller, drive mechanism for rotating the heating roller and pressure roller, and a control for initiating the rotation of the heating roller and pressure roller when the heating roller reaches a determined surface temperature or at a determined time after the heating means is activated, wherein the heating means is so activated at the turning on of the power supply as to reduce the waiting time required by the rollers to reach a satisfactory fixing temperature, thus preventing defective fixing at the start of operation.

35 Claims, 7 Drawing Figures

TONER IMAGE FIXING DEVICE

BACKGROUND OF THE INVENTION

1. Field of the Invention

The present invention relates to a fixing device, usable with an image forming apparatus, for fixing toner images.

2. Description of the Prior Art

In the fixing device with a heating roller for fixing toner image on a bearing member, there has recently been employed a pressure roller without heating means for simpler structure and reduced power consumption.

In such fixing device, however, when the power supply is turned on while both rollers are stopped, the heating roller alone is heated but the pressure roller remains almost at the room temperature so that, at the start of copying operation after the warming-up cycles the heat of the heating roller is reduced not only by the transfer, sheet but also by the pressure roller of a larger heat capacity, whereby the fixing temperature is significantly lowered to result in a defective fixing. Such phenomenon is particularly marked at the first copying operation in the morning.

In order to avoid such drawback there has been proposed a mechanism for continuously rotating the heating roller and pressure roller, a mechanism utilizing an internally heated pressure roller or a combination thereof, which however are associated with the following drawbacks:

(1) Mechanism for continuously rotating the heating roller and pressure roller:
- Longer warming-up time; and
- Shortened service life of rollers, associated with constant noise.

(2) Mechanism utilizing internally heated pressure roller:
- Longer warming-up time;
- Increased machine cost;
- Loss in power consumption, as the power allotted to the fixing device has to be divided between the fixing roller and pressure roller in such a well balanced manner as to maintain satisfactory fixing, a reasonable warming-up time and to avoid peeling of rubber layer, thus leading to a power consumption larger than in the conventional fixing device;
- Danger of peeling of rubber adhesive;
- Increase in machine cost because of the necessary temperature control and complicated structure; and
- Slow surface temperature rise of the pressure roller not sufficient for the first copying operation for example in the morning.

(3) Combination of the above-mentioned mechanisms:
- Though such combination has the advantages of these mechanisms, it also has the drawbacks thereof.

SUMMARY OF THE INVENTION

The object of the present invention is to provide a roller fixing device for use in a copier, not associated with the above-mentioned drawbacks of the conventional fixing devices and allowing satisfactory fixing performance with a simplified structure.

DETAILED DESCRIPTION OF THE PREFERRED EMBODIMENT

Figure 1:
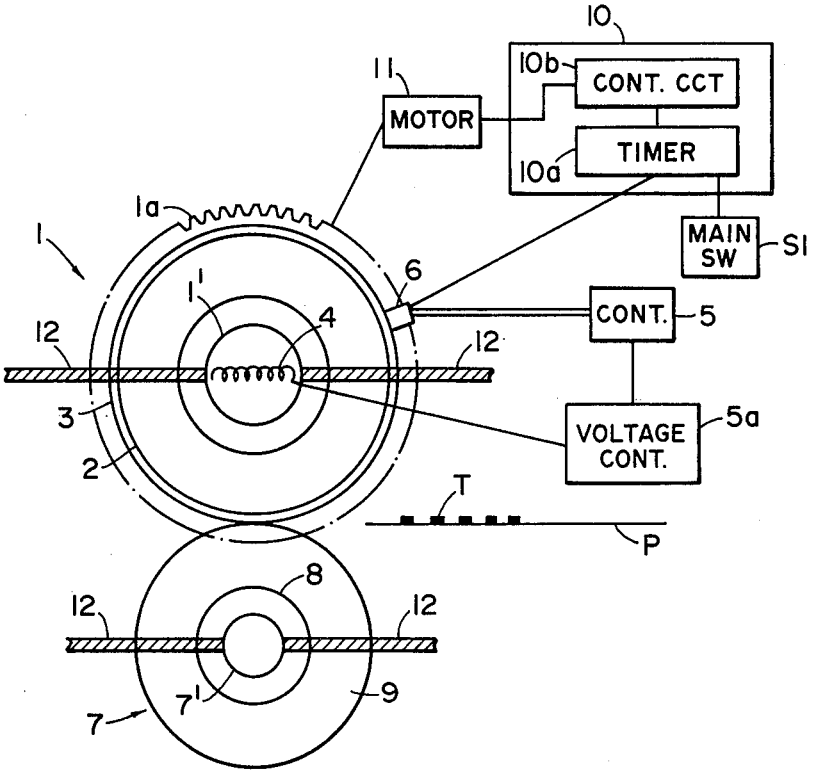
FIG. 1 is a lateral view of a fixing device embodying the present invention.

FIG. 1 shows a fixing device composed of a heating roller internally provided with heating means and a pressure roller not provided with heating means and maintained in contact with said heating roller for rotation. The heating roller 1 is composed of a roller core covered with a thin layer 3 of a releasing material such as Teflon (trade name) or a silicone robber and internally provided with heating means 4 such as a heating lamp. A controller 5 is provided for controlling said heating means 4 and adapted, in response to the surface temperature of the heating roller 1 detected by a temperature detector 6 such as thermister positioned in contact with or in the vicinity of said roller 1, to regulate a voltage controller **5*a* supplying power to said heating means 4, thereby maintaining a constant surface temperature. The pressure roller 7 maintained in pressure contact with said heating roller 1 is composed of a roller core 8 covered with a layer 9** of a releasing material such as silicone rubber.

A shaft 1' of said heating roller 1 and a shaft 7' of said pressure roller 7 are supported rotatably by known support means 12, and said rollers 1, 7 are put into rotary motion by a motor 11 connected with known drive link means. In the illustrated embodiment the heating roller 1 is driven by a gear **1*a* rotating integrally with said shaft 1', and the pressure roller 7 is driven by friction with said heating roller 1. At the fixing operation in which a toner image T is fixed onto a bearing member P, the rotation of the rollers 1, 7 is controlled in the known manner. Also said motor 11 is connected to motor control means 10 which controls the rotation of motor 11 in response to the signals from the temperature detector 6 and a main switch S1 and in cooperation with a timer circuit 10*a* and a control circuit 10*b* contained in said control means. In the above-explained embodiment, the heating roller 1 and pressure roller 7 are stopped during the warming-up cycle following the turning on of power supply, but the timer 10*a* activates the motor 11 for a determined period to drive the heating roller 1 and pressure roller 7** after a determined time when the heating roller reaches a determined surface temperature.

Figure 2:
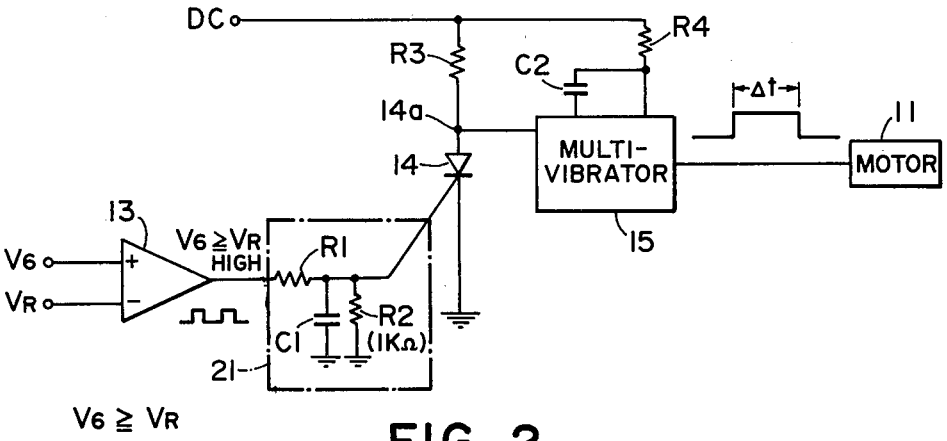
FIG. 2 is a control circuit diagram of the embodiment shown in FIG. 1 and another embodiment of the present invention.

FIG. 2 shows an example of the circuit for rotating said heating roller 1 and pressure roller 7 for a determined period when the heating roller reaches a determined surface temperature after the turning on of the power supply, wherein there are shown condensers C1, C2 and resistors R1 to R4 of suitably selected capacity or resistance, a direct-current voltage source DC, a comparator 13 for comparing an output voltage V6 from the temperature detector 6 with a reference voltage VR corresponding to a determined temperature of said heating roller 1, and input means 21 for a thyristor 14 for waveforming of the output voltage from said resistors R1, R2 condenser C1 and comparator 13. The thyristor 14, which is normally shut off, is turned on when the condenser C1 is charged to the gate voltage by the high-level signal from the comparator 13. A junction point 14*a* positioned close to said thyristor 14 and between the resistor R3 and a monostable multivibrator 15, maintained at a high potential by the voltage source DC, is shifted to a low potential by the turning on of said thyristor 14 thereby activating said monostable multivibrator 15 during a period Δt determined by the resistor R4 and condenser C2 to drive the motor 11 for said period, thus rotating the heating roller 1 and pressure roller 7. Said period Δt can be regulated by said resistor R4 and condenser C2, and this driving signal may also be utilized in driving the rollers at the fixing operation.

Thus, when the voltage V6 corresponding to the surface temperature of the heating roller 1 exceeds the reference voltage VR after the turning on of the main switch S1, the resulting signal causes the rotation of the heating roller 1 and pressure roller 7 during said period Δt, effectively elevating the surface temperature of the pressure roller 7 and achieving a satisfactory fixing state within a short time, without significant decline in the surface temperature of the heating roller 1. In this manner the defective fixation can be completely avoided in the fixation of toner image T onto the bearing member P.

Figure 3:
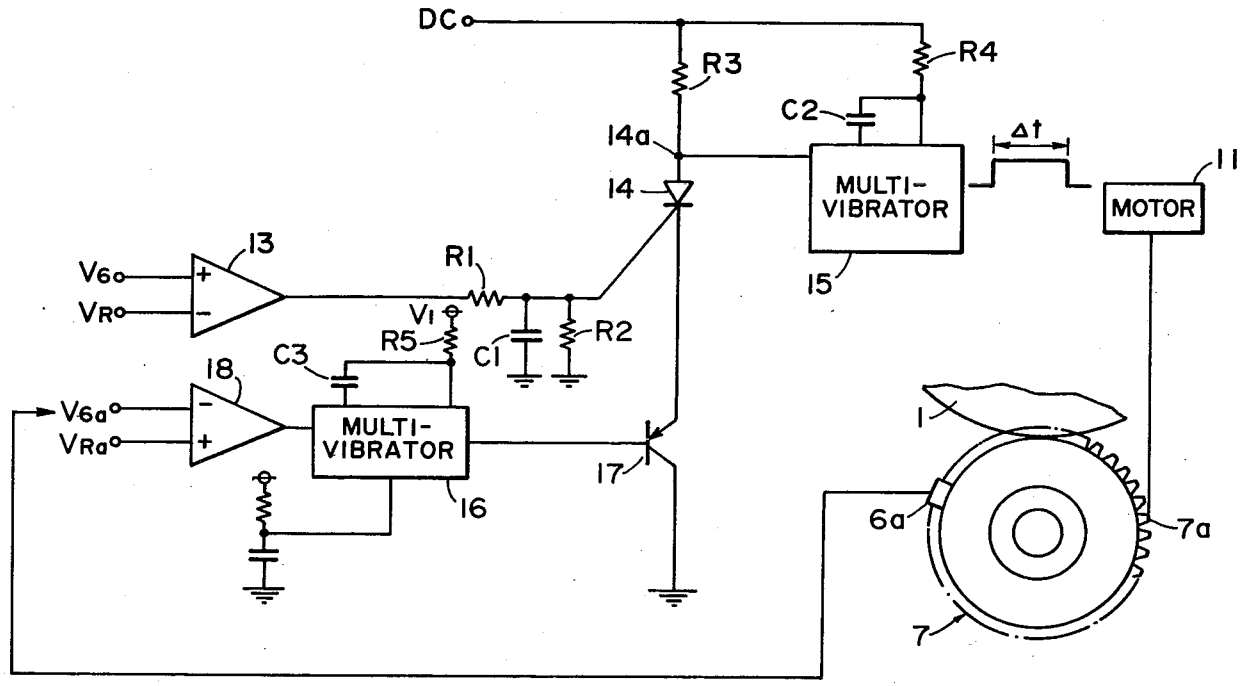
FIG. 3 is a control circuit diagram of still another embodiment of the present invention.

The circuit shown in FIG. 2 activates the motor 11 only once during the waiting time when the voltage V6 reaches the reference voltage VR, and the rollers need not be rotated thereafter since the pressure roller 7 is maintained at a temperature required for fixation through heating by the heating roller 1. In a colder area, however, said fixing device provides satisfactory image fixation at the start of copying operation but shows a significant decline in the surface temperature of the pressure roller 7 by the low atmospheric temperature if the copying operation is not conducted for a while. FIG. 3 shows another embodiment allowing satisfactory fixation even in such case.

The circuit shown in FIG. 3 is different from that of FIG. 2 in that the thyristor 14 is grounded through a circuit having a comparator 18, a monostable multivibrator 16 and a transistor 17, which will be explained in detail in the following. During the waiting time, the transistor is turned on when the voltage V6 reaches the level of the reference voltage VR to cause rotation of the heating roller 1 and pressure roller 7 thereby maintaining said rollers in satisfactory condition.

In the present embodiment, the motor 11 is connected to the pressure roller 7 which in turn drives the heating roller 1 by friction, and the temperature detector 6*a* is positioned at the surface of said pressure roller 7. The output voltage V6*a* of said temperature detector 6*a* is compared, in the comparator 18, with a reference voltage VR*a* corresponding to a temperature below which the image fixation becomes insufficient. When said output voltage V6*a* becomes lower than said reference voltage VR*a* the comparator 18 releases a high-level signal in response to which the monostable multivibrator 16 turns off the transistor 17, which has been maintained on from the start of copying operation, for a period determined by a resistor K5 and a condenser C3, said period being preferably as short as possible for releasing a signal for turning off said transistor. At the same time the thyristor 14 is turned off to shift the junction point 14*a* from the low-potential state in the aforementioned waiting time to the high-potential state, and the high-level signal from the comparator 13, as V6 is higher than VR in this state, again shifts said junction point 14*a* to the low-potential state to achieve the monostable multivibrator 15 thereby causing the rotation of the heating roller and pressure roller by the motor 11 for a period Δt.

In this manner the pressure roller is constantly maintained at a surface temperature effective for the toner image fixation, thus preventing defective fixation after a long pause in the copying operation or eventually when the fixing device is used in a cold area.

Although the circuits shown in FIGS. 2 and 3 utilize monostable multivibrators 15, 16, there may also be employed, for the purpose of the present invention, any other circuit utilizing suitable oscillators or switching elements such as bistable multivibrators for causing the rotation of the heating roller 1 and pressure roller 7 in response to the change in surface temperature thereof or by time-dependent control.

In the following the effect of the present invention will be explained in relation to FIGS. 4, 5 and 6.

Figure 4:
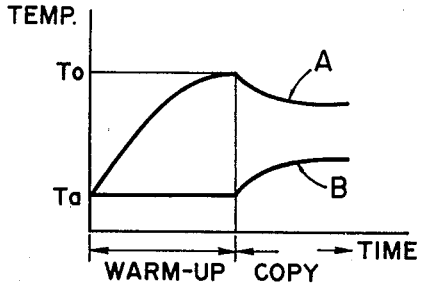
FIG. 4 is a chart showing the surface temperatures of heating roller and pressure roller as a function of time in a conventional fixing device.

FIG. 4 shows the surface temperatures of the heating roller and pressure roller, as a function of time, in a conventional fixing device similar to that shown in FIG. 1 and not provided with the control means of the present invention, wherein the curves A and B respectively stand for the heating roller 1 and pressure roller 7. As said rollers are maintained at standstill during the warming-up time, the surface temperature A of the heating roller 1 rises with time but the surface temperature B of the pressure roller 7 remains at the room temperature Ta except in a portion thereof in contact with the heating roller 1. When said rollers are put into rotary motion in the copying operation after said warming-up time, the heat of the heating roller 1 is initially not used effectively for melting the toner present on the transfer sheet but for warming the pressure roller 7. Stated differently the pressure roller shows an increase in the surface temperature B while the heating roller shows a decrease in the surface temperature A, thus leading to a defective image fixation, which is particularly marked when the room temperature is for example as low as 5° C.

According to the present invention such defective fixation can be avoided without the continuous rotation of the heating roller and pressure roller or the use of an internally heated pressure roller as proposed in the past, and a mechanism is provided in the present embodiment for rotating the heating roller and pressure roller when the heating roller reaches a determined temperature or at a determined time after the start of power supply.

Figure 5:
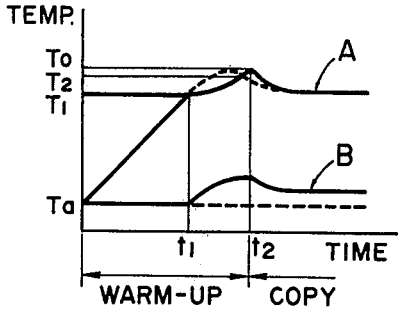
FIG. 5 is a chart similar to FIG. 4 but related to an embodiment of the present invention.
Figure 6:
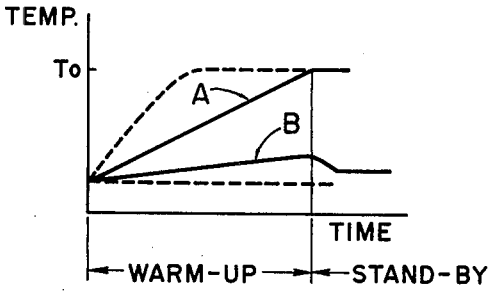
FIG. 6 is a similar chart in case the heating roller and pressure roller are driven from the beginning in a conventional fixing device.

FIG. 5 shows a representative example of the behavior or surface temperatures of the heating roller and pressure roller in the device of the present invention. In the device having a simple timer means 10*a* as shown in FIG. 1, the heating roller 1 shows an increase in the surface temperature A with time but the surface temperature B of the pressure roller 7 is maintained at the room temperature Ta during a period t1 after the start of power supply. At the time t1 during the warming-up time the timer means 10*a* activates the motor 11 to rotate the heating roller 1 and pressure roller 7 during a period t2. Owing to said rotation the pressure roller 7 shows a rise in the surface temperature, and the surface temperature of the heating roller 1 rises to a stand-by temperature To with a slightly reduced rate of temperature rise than before the start of roller rotation. Said periods t1 and t2 can be suitably selected according to the warming-up time, roller structure, power consumption, heat capacity and material of the heating roller. Also said period t2 may be initiated at time t1 and continued until a proper warming-up is completed. Also instead of the time-dependent control by the timer means 10*a* in the foregoing embodiment, there may also be employed a control in which the rotation of rollers is initiated or terminated according to the surface temperatures of said rollers or to the number of rotations of the motor.

The foregoing embodiment is most significantly characterized by a fact that the rotation of rollers is initiated at a time t1 (>0), when the heating roller reaches a determined surface temperature, after the start of power supply. If said time t1 is selected equal to zero, or, if the rollers are rotated from the beginning, there will result a radiation of the heat of heating roller 1 through the pressure roller, thus giving rise to a slower and much longer warming-up of the heating roller 1 as shown in FIG. 6 and causing thus a power loss. Also a rapid heating of the pressure roller 7 as in the present invention achieves a rapid rise in the surface temperature thereof as shown in FIG. 5 because of the heat insulating property of the surface rubber layer, but the rise in surface temperature of the pressure roller 7 becomes much slower if it is rotated with the heating roller 1 from the beginning because of the initially low surface temperature thereof and of the heat transmission into the interior of the rubber layer on said pressure roller. Consequently, the present invention allows a rapid rise in the surface temperature of the pressure roller without excessively prolonging the warming-up of the heating roller 1.

The copying operation conducted after the arrival of the heating roller 1 at the stand-by temperature To provides a satisfactory image fixation because of the reduced temperature rise of the pressure roller 7 than in the case shown in FIG. 4. The aforementioned periods t1, t2 have naturally to be determined in conderation also of the saturation temperature of said pressure roller 7 in said stand-by state.

Figure 7:
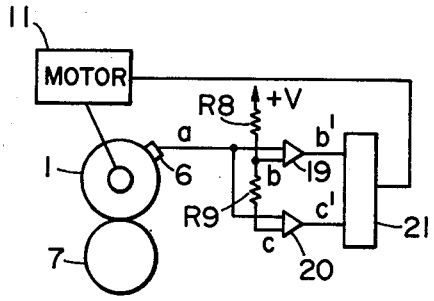
FIG. 7 is a schematic view showing another embodiment of the present invention.

Also said periods t1 and t2 may be determined in relation to a first determined temperature T1 and a second determined temperature T2 of the heating roller 1, said temperature T1 being preferably selected at least equal to 70% of the stand-by temperature. FIG. 7 shows such embodiment of the present invention, comprising comparators 19, 20, a drive control circuit 21 and a motor 11 for driving the rollers. In this embodiment the surface temperature of the roller 1 is detected by a temperature detector or thermistor 6, the detection signal of which is supplied to the comparators 19, 20 and compared respectively with a reference signal a b corresponding to the surface temperature T1 of the heating roller 1 and a reference signal c corresponding to the surface temperature T2 thereof. In case $a \geqq b$, i.e. when the heating roller 1 has a surface temperature higher than the first determined temperature T1, a signal b′ is supplied to the roller drive control circuit 21 to activate the motor 11. Also in case $a \geqq c$, i.e. when the heating roller 1 has a surface temperature higher than the second determined temperature T2, a signal c′ is supplied to said control circuit 21 to terminate the motor rotation. In this manner the aforementioned effects can be obtained in combination.

In the foregoing embodiments the rotation of the rollers may be achieved by any suitable control means functioning in mechanical, electrical or time-dependent manner.

As detailedly explained in the foregoing, the present invention is featured in initiating the rotation of the heating roller and pressure roller after the lapse of a determined period in the warming-up cycle following the turning on of power supply thereby accelerating the heating of pressure roller and maintaining the surface temperature thereof higher than the room temperature, and thus provides an inexpensive fixing device capable of satisfactory image fixation from the start of copying operation without increase in power consumption. Also the above-mentioned sequence may also be designed to function only at a low ambient temperature. Also such rotation may be repeated at regular intervals or when necessitated, and the period of such sequence is arbitrarily selectable. Furthermore said heating roller and pressure roller may be so designed that either is driven by the other by friction or the both are driven by independent drive sources.

In this manner the present invention is capable of preventing defecting image fixation without the continuous rotation of the heating roller and pressure roller or without the use of an internally heated pressure roller.

What I claim is:

1. A fixing device, comprising:

a heating roller having heating means;

a pressure roller for fixing a toner image on a toner image bearing member to be transported between said heating roller and said pressure roller;

drive means for rotating said heating roller and said pressure roller; and control means for causing rotation of said heating roller and pressure roller when said heating roller reaches a predetermined surface temperature after the start of function of said heating means.

2. A fixing device according to the claim 1, wherein said control means comprises timer means for determining the time for initiating said rotation of rollers.

3. A fixing device according to the claim 1, wherein said control means comprises a temperature detector for detecting the surface temperature of said heating roller in order to control said drive means.

4. A fixing device according to the claim 3, wherein said control means comprises comparator means for comparing a signal from said temperature detector with a reference signal corresponding to said predetermined temperature.

5. A fixing device, comprising:

a heating roller having heating means;

a pressure roller for fixing a toner image on a toner image bearing member to be transported between said heating roller and said pressure roller;

drive means for rotating said heating roller and said pressure roller; and control means adapted to activate said drive means to initiate the rotation of said heating roller and pressure roller when said heating roller reaches a first surface temperature and to terminate said rotation when said heating roller reaches a second surface temperature higher than said first surface temperature.

6. A fixing device according to the claim 5, wherein said control means comprises timer means for initiating and terminating said rotation of the rollers.

7. A fixing device according to the claim 5, wherein said control means comprises a temperature detector for detecting the surface temperature of said heating roller in order to control said drive means.

8. A fixing device according to the claim 7, wherein said control means comprises comparator means for comparing a signal from said temperature detector with a reference signal corresponding to a first temperature and with a reference signal corresponding to a second temperature.

9. A device according to claim 5, wherein the first surface temperature is not lower than 70% of said second surface temperature.

10. A device according to claim 5, wherein the second surface temperature is a predetermined temperature which is predetermined for the stand-by state.

11. A device according to claim 5, wherein said second surface temperature is a temperature representing completion of warm-up rotation.

12. A device according to claim 10, wherein the first surface temperature is not lower than 70% of the stand-by temperature.

13. A fixing device, comprising:

a heating roller having heating means;

a pressure roller for fixing a toner image on a toner image bearing member to be transported between said heating roller and said pressure roller;

drive means for rotating said heating roller and said pressure roller; and control means for causing the rotation of said heating roller and pressure roller at a predetermined time after the start of function of said heating means.

14. A fixing device, comprising:

a heating roller having heating means;

a pressure roller for fixing a toner image on a toner image bearing member to be transported between said heating roller and said pressure roller;

drive means for rotating said heating roller and said pressure roller; and control means for causing rotation of said heating roller and pressure roller at a predetermined period after the start of function of said heating means and terminating said rotation after the lapse of a second predetermined period.

15. A fixing device according to any one of claims 1, 5, 13 or 14, wherein said control means comprises temperature detecting means for detecting the surface temperature of said pressure roller and means for causing rotation of said heating roller and pressure roller when said surface temperature of said pressure roller is identified by said temperature detecting means as lower than a predetermined temperature.

16. A fixing device according any one of claims 1 to 14, wherein said pressure roller is provided with a surfacial rubber layer.

17. A fixing device according to the claim 16, wherein said heating roller and pressure roller are constantly maintained in pressure contact.

18. A fixing device according to any one of claims 1 to 14, wherein said heating means comprises means for controlling the temperature of said heating means in order to maintain at least the heating roller at the fixing temperature after the start of operation.

19. A fixing device according to claim 15, wherein said pressure roller is provided with a surfacial rubber layer.

20. A device according to claim 14, wherein the predetermined period is the period from the first predetermined time to the surface temperature of the heating roller reaching a predetermined temperature which is predetermined for a stand-by state.

21. A device according to claim 14, wherein the predetermined period is the period from the first predetermined time to the completion of warm-up operation.

22. A device according to any one of claims 10, 11, 20 of 21, wherein said control means comprises temperature detecting means for detecting the surface temperature of said pressure roller and means for causing rotation of said heating roller and pressure roller when said surface temperature of pressure roller is identified by said temperature detecting means as lower than a determined temperature.

23. A device according to claim 22, wherein said pressure roller is provided with a surfacial rubber layer.

24. A device according to claim 23, wherein said heating roller and pressure roller are constantly maintained in pressure contact.

25. A tone image fixing device, comprising:

a fixing roller;

heating means for heating said fixing roller;

a pressure roller for cooperating with said fixing roller to fix a toner image on a toner image bearing member when it is transported between said fixing roller and said pressure roller;

drive means for rotating said fixing roller and said pressure roller; and control means for causing rotation of said fixing roller and pressure roller when said fixing roller has attained a first predetermined temperature which is not higher than a second temperature which is predetermined for a stand-by state, after the start of operation of said heating means.

26. A device according to claim 25, wherein said first predetermined temperature is not higher than a temperature representing completion of warm-up operation.

27. A device according to claim 25, wherein said first predetermined temperature is not lower than 70% of said second predetermined temperature.

28. A toner image fixing device, comprising:

a fixing roller;

heating means for heating said fixing roller;

a pressure roller for cooperating with said fixing roller to fix a toner image on a toner image bearing member when it is transported between said fixing roller and said pressure roller;

drive means for rotating said fixing roller and said pressure roller; and control means for causing the rotation of said fixing roller and pressure roller at a predetermined time which is on or before the temperature of said fixing roller attains a value which is predetermined for a stand-by state, after the start of function of said heating means.

29. A device according to claim 28, wherein the predetermined time is on or before completion of warm-up time.

30. A device according to any one of claims 25, 26, 27, 28 or 29, wherein said control means comprises temperature detecting means for detecting the temperature of said pressure roller and means for causing rotation of said fixing roller and pressure roller when said temperature of pressure roller is identified by said temperature detecting means as lower than a predetermined temperature.

31. A device according to the claim 30, wherein said pressure roller is provided with a surfacial rubber layer.

32. A device according to claim 31, wherein said fixing roller and pressure roller are constantly maintained in pressure contact.

33. A toner image fixing device, comprising:

heating means;

a first roller associated with said heating means;

a second roller cooperative with said first roller to fix, therebetween, with heat, a toner image on an image bearing member;

drive means for rotating said first and second rollers;

means for detecting a temperature of at least one of said first and second rollers; and control means for detecting that said at least one of said first and second rollers has attained a predetermined temperature and to start rotation of said first and second rollers responsive thereto.

34. A device according to claim 33, wherein said second roller is not directly heated by said heating means, and the temperature of the second roller is detected by said detecting means, and wherein the predetermined temperature is a temperature at which incomplete fixing operation occurs.

35. A device according to claim 33, wherein the predetermined temperature is a temperature at which incomplete fixing operation occurs.

* * * * *

UNITED STATES PATENT AND TRADEMARK OFFICE

CERTIFICATE OF CORRECTION

PATENT NO. : 4,385,826

DATED : May 31, 1983

INVENTOR(S) : MASAYUKI ITOH

It is certified that error appears in the above-identified patent and that said Letters Patent is hereby corrected as shown below:

Column 1, line 19, change "cycles" to --cycle,--;
line 20, insert a "," after "reduced";
line 21, delete the "," after "transfer".

Column 2, line 29, "robber" should read --rubber--.

Column 4, line 12, "achieve" should read --activate--.

Column 5, line 47, "conderation" should read --consideration--;
line 55, insert --an-- between "such" and "embodiment".

Column 6, line 29, "defecting" should read --defective--.

Column 7, line 58, insert --to-- after "according".

Column 8, line 13, Claim 22, "of" should read --or--;
line 25, Claim 25, "tone" should read --toner--.

Signed and Sealed this

Twenty-second Day of November 1983

[SEAL]

Attest:

GERALD J. MOSSINGHOFF

Attesting Officer

Commissioner of Patents and Trademarks